United States Patent [19]

Ames

[11] 3,976,459

[45] Aug. 24, 1976

[54] CHILL COOLER

[76] Inventor: Willard H. Ames, 10905 N. Oriole Lane 20 W., Mequon, Wis. 53092

[22] Filed: Feb. 6, 1975

[21] Appl. No.: 547,437

[52] U.S. Cl. ..... 62/266; 62/380
[51] Int. Cl.[2] ..... F25D 23/02
[58] Field of Search ..... 62/265, 266, 378, 380; 49/68

[56] References Cited

UNITED STATES PATENTS

| | | | |
|---|---|---|---|
| 264,210 | 9/1882 | Waterman | 62/266 |
| 1,018,180 | 2/1912 | Gallagher | 62/265 |
| 1,955,669 | 4/1934 | Botz | 62/380 |
| 2,254,420 | 9/1941 | Cleveland | 62/380 |
| 2,259,007 | 10/1941 | Story | 62/378 |
| 2,486,876 | 11/1949 | Protzeller | 62/380 |
| 2,489,918 | 11/1949 | Menges | 62/380 |
| 2,513,355 | 7/1950 | Peckinpaugh | 62/378 |
| 3,045,615 | 7/1962 | Atchison | 49/68 |
| 3,769,807 | 11/1963 | Foster | 62/380 |

*Primary Examiner*—Lloyd L. King
*Attorney, Agent, or Firm*—Fred Wiviott

[57] ABSTRACT

A chill cooler for meat packing plants having a revolving air interlock for separating the same from the kill floor. The air lock includes a vertically oriented cylindrical housing having a first entrance opening to the kill floor and a second exit opening to the cooler. A plurality of doors rotate about the axis of the cylindrical housing and their outer edges are in sealing wiping engagement with the internal housing surface to isolate the kill floor from the cooler as meat sections are conveyed through the air interlock. A conveyor passes through a compartment disposed above the doors for moving meat through the air lock.

18 Claims, 6 Drawing Figures

CHILL COOLER

BACKGROUND OF THE INVENTION

Meat packing plants generally include an area called a kill floor where the animals are slaughtered, sectioned and the hides, organs and the like are removed. The meat sections are then transferred to a cooling area where the meat is initially chilled and thereafter held pending further processing. It will be appreciated that the temperature of the kill floor is substantially higher than that of the cooler. While prior art packing plants were provided with various types of automatic doors between these areas, the latter were required to be opened frequently to permit the passage of meat from the kill floor to the cooler. As a result, there was a substantial interchange of cool air from the cooler and warm air from the kill floor. This not only increased the refrigeration requirements of the cooler but caused undesirable sweating and condensation to occur on the meat.

SUMMARY OF THE INVENTION

It is a primary object of the invention to provide a packing plant cooler with a new and improved air lock system which substantially minimizes the interchange of air between the cooler and the kill floor.

A further object of the invention is to provide apparatus for permitting the passage of meat from a packing plant kill floor to a chill cooler but which prevents a substantial flow of air therebetween.

These and other objects and advantages of the present invention will become more apparent from the detailed description taken with the accompanying drawings.

BREIF DESCRIPTION OF THE DRAWINGS

DETAILED DESCRIPTION OF THE INVENTION

Figure 1:
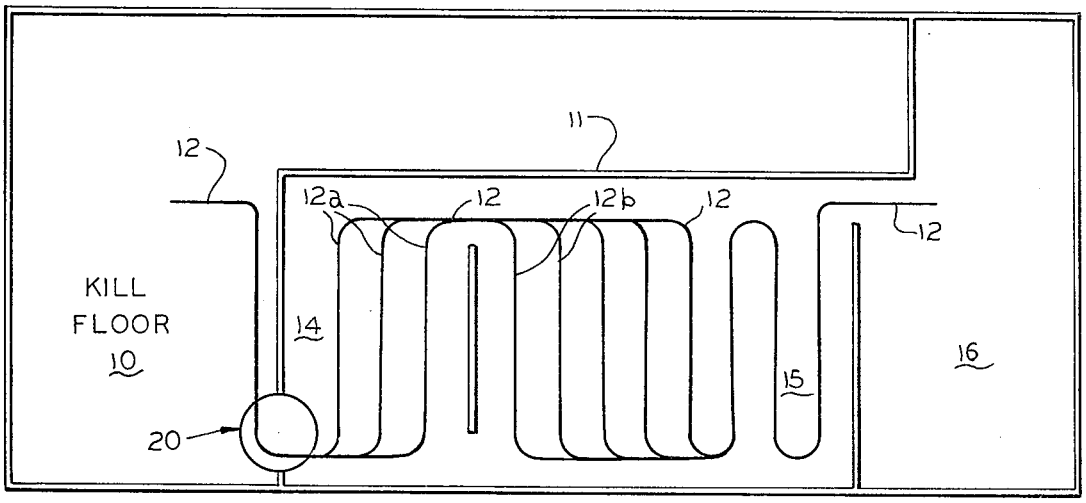
FIG. 1 is a plan view schematically illustrating a packing plant incorporating a cooler in accordance with the present invention.

FIG. 1 schematically illustrates a plan view of a packing plant incorporating a cooler to the present invention. In general, the plant includes a kill floor 10 in which the animals are slaughtered and sectioned and various parts such as hides, organs and the like are removed and dispatched to other areas of the plant for further processing. The meat sections are then typically transferred to a cooler 11 by means of an overhead conveyor system as will be more fully discussed below. The cooler 11 is divided into a chill cooler portion wherein the meat is initially chilled and a holding cooler portion 15 wherein the meat is stored pending further processing in the processing room 16. The overhead conveyor 12 extends through the chill cooler 14 and holding cooler 15 and into the processing room 16. The conveyor 12 may also include numerous parallel branch lines 12*a* and 12*b* which permit meat to be stored or transported along various parallel paths. An air lock system according to the present invention is schematically illustrated in FIG. 1 at 20.

Figure 2:
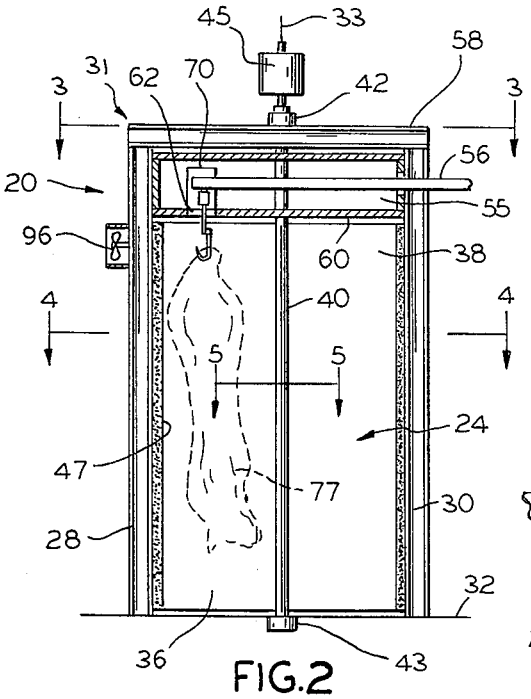
FIG. 2 is a side elevational view of the air lock system of a cooler according to the present invention with parts broken away.
Figure 3:
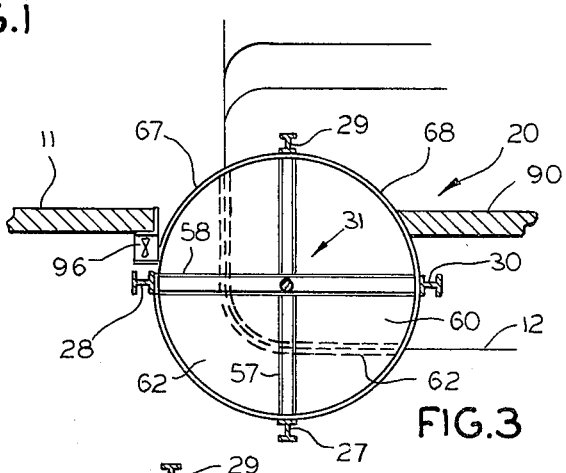
FIG. 3 is a view taken along lines 3—3 of FIG. 2.
Figure 4:
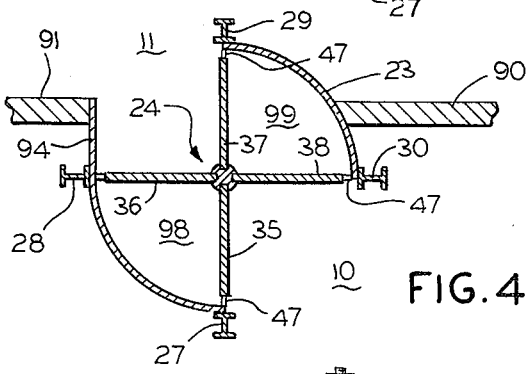
FIG. 4 is a view taken along lines 4—4 of FIG. 2.

Referring now to FIGS. 2, 3 and 4 the air interlock 20 is shown to include a pair of generally vertical oriented, cylindrical sections 22 and 23, a rotating door assembly 24 and a support frame 25. Sections 22 and 23 may be of any sheet material such as metal. The support frame 25 may take 28, 29 convenient form such as four vertical frame members 27, 28 and 30 and a cross frame assembly 31 which connects their upper ends. The frame member 27–30 are suitably affixed in floor 32 in equispace relation about a central axis 33 such that a radial angle between any two of said members is approximately 90°. The cylindrical section 22 is suitably affixed to and extends between the vertical support members 27 and 28 and the cylindrical section 23 is suitably affixed to and extends between the vertical support members 29 and 30. Sections 22 and 23 are thus spaced apart on the opposite sides of axis 32 and each intercepts a radial angle of approximately 90°. As a result, the section 22 and 30 in effect form two portions of a cylindrical surface with the intervening portions of which are open.

Figure 5:
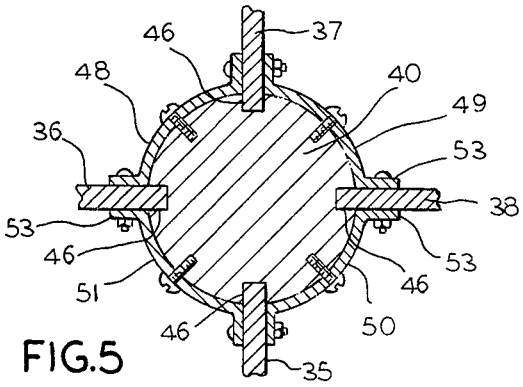
FIG. 5 is an enlarged view taken along lines 5—5 of FIG. 2.

The door assembly 24 includes four door panels 35, 36, 37 and 38 which extend radially at equal angles of about 90° from a central support post 40. Support post 40 is mounted for rotation about the vertical axis 33 by means of a first bearing 42 mounted at the center of the cross frame assembly 34 and a second bearing 43 mounted in floor 32. If the door assembly 24 is to be driven, a suitable drive motor 45 may be coupled to post 40 above bearing 42. Alternatively, the rail 12 may be inclined so that the meat section will move through the air lock by gravity wherein the weight of the meat will cause the door panels 35–38 to rotate. The door panels 35–38 may be identical and each may be composed of a transparent panel member formed of glass or plastic and each may have a flexible vertically extending wiper 47 affixed at its outer end for engaging the inner surface of the cylindrical sections 22 and 23 in a sealing, wiping relation. In addition, the panels 35–38 may be affixed at their inner ends to the central support post in any convenient manner. For example, as illustrated in FIG. 5, the post 40 may have four vertically extending grooves 46 each of which receives the inner end of one of the panels 35–38. In addition, vertical molding strips 48, 49, 50 and 51 are affixed to post 40 between each of the panel members 35, 36, 37 and 38 and each also includes a flange 53 at each of its ends between which said panels are bolted.

Figure 6:
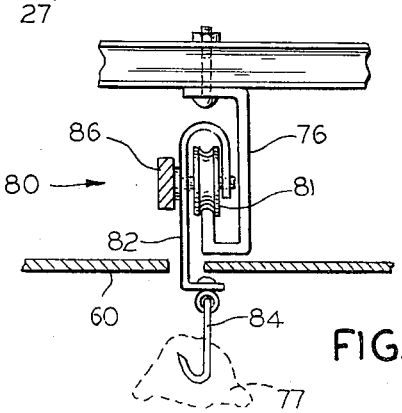
FIG. 6 is an enlarged view of a portion of a conveyor assembly of the cooler illustrated in FIG. 1.

As seen in FIG. 2, the upper ends of the door panels 35–38 are spaced below the top frame assembly 31 to define a space 55 through which the overhead conveyor 12 passes. As seen in FIGS. 2 and 6, the conveyor 12 which may take any convenient forms such as a rail 56 which enters the space 55 between the vertical support posts 27 and 30 and passes below the midpoint of one of arms 57 of cross frame member 31. The rail 12 then swings through an arc having a central angle of approximately 90° and passes under the midpoint of a second arm 58 of cross member 31 and continues outwardly of the space 55 and between the frame members 28 and 29. The rail 56 thereby affects a 90° change in direction in the space 55.

Affixed to the vertical support posts 27–30 and immediately above the upper edges of the doors 36–38 for defining the lower end of the space 55, is a generally circular baffle 60. A slot 62 is formed in the baffle 60 immediately below the rail 56 and has the same configurations as that portion of the rail 56 that lies within the space 55. The space 55 is further defined by a top panel 64 disposed above the cross frame assembly 31 and a plurality of arcuate side panels 66–69. The panels 67 and 69 are provided with vertical slots 70 and 71 respectively which permit the rail 56 to pass therethrough.

The rail 56 may be suitably supported in a generally horizontal relation below overhead supports such as the arm 57 of cross frame assembly 32 by means of a bracket 76 as shown in FIG. 6. A meat section 77 may be supported on rail 56 by means of a conventional trolley assembly 80. More specifically, trolley 80 may include a wheel 81 mounted on rail 56 and journaled for rotation in a frame 82 which extends downwardly from wheel 81 and through the slot 62 in panel 60 for supporting a meat engaging hook 84 at its lower end. The trolley 80 may include any well known conveying attachment, such as for example, a lug 86 which extends from one side of frame 82 for being suitably engaged by a coacting member of a drive (not shown). In this manner, the meat 77 is conveyed to the air lock 20. The operation of motor 32 to rotate doors 35–38 drives the meat section 77 through the air lock assembly 20 where it may be further conveyed by the drive (not shown) acting on lugs 86.

As seen in FIG. 3, one wall 90 of the cooler 11 intersects the outer surface of cylindrical section 20 while the second wall 91 is spaced from the end of section 22. A tangential extension 94 of section 22 is disposed between the ends of wall 91 in the section 22 to close the gap therebetween. An exhaust fan 96 may be disposed in extension 94.

As seen in FIG. 4, the doors 35–38, the sections 22, 23, wall 91 and extension 94 are arranged such that the doors coincide with the radial angle of the sections 22 and 23. Accordingly, during clockwise rotation of door 35–38 as viewed in FIG. 4, when the door 36 is on the leading edge of section 22 the door 35 will be on the trailing edge and simultaneously the door 38 will be on the leading edge of section 23 and the trailing door 37 will be on the trailing edge thereof. In this position, a first enclosure 98 will be defined by section 22 when doors 35 and 36 and a second enclosure 99 will be defined by section 23 in doors 37 and 38. Enclosure 98 will contain warm air from kill floor 10 and enclosure 99 will contain cool air from the cooler 11. As the leading door 36 moves off the section 22 and onto the extensions 94, the exhaust fan 96 will begin to withdraw the relatively warmer air from the compartment 98 and exhaust the same back into the kill floor 10. Exhaust fan 96 may be energized continuously or it may be energized by limit switches (not shown) which are actuated when one of the doors 35–38 moves off of section 22 and onto extension 94 and which is deactuated when the same door moves off of extension 94 and past the end of wall 91.

It will be appreciated from the foregoing that the air lock assembly 20 according to the invention isolates the kill floor 10 from the cooler 11 and minimizes the interchange of air therebetween. This reduces condensation and frost in the cooler 11 and conserves the energy of refrigeration.

While only a single embodiment of the invention is shown and described, it is not intended to be limited thereby but only by the scope of the appended claims.

I claim:

1. A cooler for use in a packing plant, said cooler including and enclosure in which a product is cooled, an air lock system for minimizing the exchange of air between said cooler and the other portions of said plant, said air lock system including:

cylindrical housing means having an entrance opening and and exit opening spaced from said entrance opening, a plurality of spaced apart door panel means mounted for rotation about the axis of said cylindrical housing means and each of said door panel means having an outer edge in proximity to the inner surface of said cylindrical housing, and vertical wall means extending tangentially from said cylindrical housing means and adjacent said exit opening, said vertical wall means extending generally in the direction of rotation of said door panel means, and exhaust fan means mounted in said vertical wall means for exhausting air from between adjacent pair of said door panels as the latter rotate.

2. The cooler set forth in claim 1 wherein said housing means comprises first and second space cylindrical sections the opposite ends of which are equispaced to define gaps therebetween which comprise said entrance and exit openings.

3. The cooler set forth in claim 2 wherein each of said spaced cylindrical sections intercepts an arc of approximately 90°, and four door panel means radiate at angles of approximately 90° from a vertical support means.

4. The cooler set forth in claim 1 and including rotatably mounted vertical support means disposed along the axis of said cylindrical housing means, said door panel means being affixed to and rotatable with said vertical support means.

5. The cooler set forth in claim 4 and including drive motor means coupled to said vertical support means for rotating said door panel means.

6. The cooler set forth in claim 1 and further including wiper means disposed at the outer edge of said door panel means for providing a sealing wiping engagement with said cylindrical housing means.

7. A cooler for use in a packing plant, said cooler including an enclosure in which a product is cooled, an air lock system for minimizing the exchange of air between said cooler and the other portions of said plant, said air lock system including:

cylindrical housing means having an entrance opening and an exit opening spaced from said entrance opening, a plurality of spaced apart door panel means mounted for rotation about the axis of said cylindrical housing means and each of said door panel means having an outer edge in proximity to the inner surface of said cylindrical housing and conveying means extending through an upper end of said cylindrical housing means above said door panel means and passing through said entrance and exit openings.

8. The cooler set forth in claim 7 and including enclosure defining means disposed above said door panel means and consisting of spaced apart generally circular partition members and a generally vertically extending side wall portion generally corresponding with and being extensions of said cylindrical housing means, said conveying means extending through said enclosure defining means.

9. The cooler set forth in claim 8 wherein said conveying means comprises a generally horizontally extending track means extending through said enclosure defining means, at least a portion of said track means defining an arc generally parallel to a portion of said cylindrical housing means to provide a direction change as said rail means passes through said enclosure defining means and trolley means mounted on said rail means for supporting a meat section.

10. The cooler set forth in claim 9 wherein slot means is formed in the lowermost of said partitions and being generally parallel to and spaced below said rail means to permit a meat engaging hook to pass therethrough as said trolley means passes through said enclosure defining means.

11. The cooler set forth in claim 10 wherein said housing means comprises first and second spaced cylindrical sections the opposite ends of which are equally spaced to define gaps therebetween which comprise said entrance and exit openings.

12. The cooler set forth in claim 11 and including rotatably mounted vertical support means disposed along the axis of said cylindrical housing means, said door panel means being affixed to and rotatable with said vertical support means.

13. The cooler set forth in claim 12 and including vertical wall means extending tangentially from said cylindrical housing means and adjacent said exit opening, said vertical wall means extending generally in the direction of rotation of said door panel means, and exhaust fan means mounted in said vertical wall means for exhausting air from between adjacent pairs of said door panels as the latter rotate.

14. The cooler set forth in claim 13 and including drive motor means coupled to said vertical support means for rotating said door panel means.

15. The cooler set forth in claim 14 wherein each of said spaced cylindrical sections intercepts an arc of approximately 90°, and four door panel means radiate at angles of approximately 90° from said vertical support means.

16. The cooler set forth in claim 15 and further including wiper means disposed at the outer edge of said door panel means for providing a sealing wiping engagement with said cylindrical housing means.

17. The cooler set forth in claim 7 and including vertical wall means extending tangentially from said housing means and adjacent said exit opening, said vertical wall means extending generally in the direction of rotation of said door panel means, and exhaust fan means mounted in said vertical wall means for exhausting air from between adjacent pairs of said door panels as the latter rotate.

18. The cooler set forth in claim 7 wherein said conveying means comprises a generally horizontally extending track means extending through said enclosure defining means, at least a portion of said track means defining an arc generally parallel to a portion of said cylindrical housing means to provide a direction change as said rail means passes through said enclosure defining means and trolley means mounted on said rail means for supporting a meat section.

* * * * *

UNITED STATES PATENT OFFICE

CERTIFICATE OF CORRECTION

Patent No. 3,976,459 Dated August 24, 1976

Inventor(s) Willard H. Ames

It is certified that error appears in the above-identified patent and that said Letters Patent are hereby corrected as shown below:

Claim 1, Column 4, line 3, cancel "and" and substitute --an--; line 9, before "exit" cancel "and" and substitute --an--; line 22, cancel "pair" and substitute --pairs--.

Claim 2, Column 4, line 25, cancel "space" and substitute --spaced-

Claim 17, Column 6, line 17, before "housing" insert --cylindrical--

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*